US005587773A

United States Patent [19]

Yano et al.

[11] Patent Number: 5,587,773

[45] Date of Patent: Dec. 24, 1996

[54] ELECTROPHOTOGRAPHIC APPARATUS FOR PERFORMING IMAGE EXPOSURE AND DEVELOPMENT SIMULTANEOUSLY

[75] Inventors: Hideyuki Yano; Junji Araya, both of Yokohama; Yukihiro Ozeki, Tokyo; Harumi Kugo, Kawasaki; Katsuhiro Sakaizawa, Tokyo; Tadashi Furuya; Osamu Iwasaki, both of Yokohama, all of Japan

[73] Assignee: Canon Kabushiki Kaisha, Tokyo, Japan

[21] Appl. No.: 366,431

[22] Filed: Dec. 30, 1994

Related U.S. Application Data

[63] Continuation of Ser. No. 172,053, Dec. 23, 1993, abandoned.

[30] Foreign Application Priority Data

Dec. 26, 1992 [JP] Japan ..... 4-359310

[51] Int. Cl.[6] ..... G03G 15/00

[52] U.S. Cl. ..... 355/210; 355/211; 355/228

[58] Field of Search ..... 355/210–212, 355/228; 347/112, 129, 130, 138; 358/296, 298, 300, 302

[56] References Cited

U.S. PATENT DOCUMENTS

| | | | |
|---|---|---|---|
| 3,526,879 | 9/1970 | Gundlach et al. | 365/126 |
| 3,772,010 | 11/1973 | Weiss | 346/160 X |
| 3,924,945 | 12/1975 | Weigl | 355/258 |
| 4,547,737 | 10/1985 | Kaneko et al. | 346/160 |
| 4,631,559 | 12/1986 | Kaneko | 346/160.1 X |
| 4,851,926 | 7/1989 | Ishikawa | 346/160 X |
| 4,931,876 | 6/1990 | Hashizume et al. | 346/160 X |
| 5,051,328 | 9/1991 | Andrews et al. | 346/160 X |
| 5,138,387 | 8/1992 | Sato et al. | 355/251 |
| 5,144,368 | 9/1992 | Ohzeki et al. | 355/219 |
| 5,159,389 | 10/1992 | Minami et al. | 355/211 |
| 5,172,163 | 12/1992 | Yamaoki et al. | 355/210 |
| 5,202,729 | 4/1993 | Miyamoto et al. | 355/251 |
| 5,272,508 | 12/1993 | Sakakibara et al. | 355/211 X |
| 5,291,246 | 3/1994 | Tsukamoto | 355/210 |
| 5,298,945 | 3/1994 | Wada et al. | 355/210 |
| 5,374,978 | 12/1994 | Asanae et al. | 355/210 |
| 5,396,315 | 3/1995 | Tsukamoto | 355/210 X |
| 5,532,796 | 7/1996 | Narikawa et al. | 355/210 X |
| 5,534,978 | 7/1996 | Nakamura et al. | 355/211 |

FOREIGN PATENT DOCUMENTS

| | | |
|---|---|---|
| 0464749 | 1/1992 | European Pat. Off. . |
| 58-153957 | 9/1983 | Japan . |
| 62-209470 | 9/1987 | Japan . |
| 63-91667 | 4/1988 | Japan . |
| 0174443 | 6/1992 | Japan . |

OTHER PUBLICATIONS

*Patent Abstracts of Japan,* vol. 7, No. 212, p. 224, Abstract of JP58–107554, Tetsuya, F., "Formation of Image". [Published Jun. 27, 1983].

*Patent Abstracts of Japan,* vol. 7, No. 274, p–241, Abstract of JP58–153957, Hiroshi, O. et al., "Method and Device for Image Recording". [Published Sep. 13, 1983].

European Search Report dated May 11, 1994.

Research Disclosure, May 1973, pp. 76 to 79.

*Primary Examiner*—Matthew S. Smith

*Attorney, Agent, or Firm*—Fitzpatrick, Cella, Harper & Scinto

[57] ABSTRACT

An electrophotographic apparatus for simultaneously performing image exposure and development including an electrophotographic photosensitive body comprising a conductive layer and an electrophotographic photosensitive layer formed on the translucent substrate. An optical system is provided for exposing the image from the side of the translucent substrate of the photosensitive body, and a developer apparatus is arranged opposing to the side of photosensitive layer of the exposure position of the photosensitive body for supplying developer charged with the developing bias.

4 Claims, 3 Drawing Sheets

ELECTROPHOTOGRAPHIC APPARATUS FOR PERFORMING IMAGE EXPOSURE AND DEVELOPMENT SIMULTANEOUSLY

This application is a continuation of application Ser. No. 08/172,053 filed Dec. 23, 1993, now abandoned.

BACKGROUND OF THE INVENTION

1. Field of the Invention

The present invention relates to an image forming apparatus of the electrophotographic type for forming an electrostatic latent image on a photosensitive body and for developing the resultant electrostatic latent image with toner.

2. Related Background Art

As means for obtaining a hard copy (such as a copying machine, a computer, or the like) image forming apparatus utilizing an electrophotographic method have been widely used. A typical image forming apparatus has a photosensitive body and various devices for image formation arranged around the photosensitive body. More specifically, around the photosensitive body, there are provided a charger device, an exposure device, a developer device, a transfer device, a cleaning device, and so on. This image forming apparatus of an electrophotographic method carries out an image forming process comprising steps of charging the photosensitive body with electricity, exposing the photosensitive body to light in order to form an electrostatic latent image on the photosensitive body, developing the resultant electrostatic latent image by applying toner to it to obtain a toner image, transferring the developed toner image onto a transfer medium, and subsequently fixing the transferred toner image on the transfer medium to finally obtain a print image.

Compared with print images obtained from other means for obtaining hard copies such as those of the thermal transfer type, the ink jet type, the impact printing type, or the like, the print image obtained as described above has higher resolution and stronger contrast, that is, as a whole, higher quality.

However, as described before, the image forming process by the electrophotographic method requires many devices. So, the apparatus therefor tends to be of a large size and complicated. It is not easy to miniaturize and simplify the apparatus.

In order to solve this problem, some methods have been proposed in which, while using the same electrophotographic method, the apparatus carries out all the processes such as electrification, exposure development, and so on substantially at the same time and at the same position (such combined processes will be referred to herein as a "simplified process"). Among such methods, typical ones are disclosed, for example, in Japanese Laid-Open Patent Appln. Nos. 58-153957, 62-209470 and the like. In general, in these methods, either conductive toner or conductive carriers, and insulating toner are used, and the image forming process comprises steps of (1) cleaning the residual toner which was not transferred in a previous image forming process; (2) contact electrification; (3) image exposure from the back surface of the photosensitive body; and (4) contact development. The series of steps are performed in a developing nip between the photosensitive body and a magnetic brush roller which corresponds to an exposure position on the back surface of the photosensitive body and which is in contact with the outer surface of the photosensitive body.

More specifically, as shown in FIG. 2, a magnetic brush provided upstream in the developing nip N between a developer sleeve 22 and a photosensitive body 1 scrapes off the residual toner which was not transferred (hereinafter referred to as "transfer residual toner") to clean the photosensitive body 1. As the toner employed here is a magnetic toner T and a fixed magnet 23 is arranged inside the developer sleeve 22, magnetic force can improve the cleaning effect.

Then, the surface of the photosensitive body 1 is brushed by a conductive magnetic brush (of conductive toner or conductive carriers) to apply an electric charge to the surface of the photosensitive body 1. As the electrification is carried out by trapping electric charge in impurity levels on the surface of the photosensitive body 1, charger member(s) having very small resistance and a long period of electrification are required to carry out electrification sufficiently. Therefore, a material which sufficiently holds electricity near its surface is needed. Amorphous silicon (hereinafter referred to as "a-Si"), selenium, and so on are preferably used.

The above-mentioned cleaning operation and electrification are performed at the same time in a cleaning-electrification region Nc, which is in the developing nip N and upstream with respect to a back surface exposure position A (described later). Incidentally, the potential of the charged photosensitive body 1 brushed with the magnetic brush is substantially equal to the applied voltage or less.

Next, the back surface of the photosensitive body 1 is exposed to light. A light source (exposure means) 3 having an LED array 31 illuminates a predetermined position (back surface exposure position) in the developing nip N formed by developer between the developer sleeve 22 and the photosensitive body 1. Thus, a latent image is formed on the exposed photosensitive body 1. The latent image is developed in a development region $N_D$, which is downstream with respect to the back surface exposure position A, in the developing nip N. When conductive toner is used, the electric charge electrostatically induced by the latent image formed on the photosensitive body 1 is applied via a triboelectric brush to the toner at the tip of the triboelectric brush. The latent image is developed with toner separated from the triboelectric brush by a Coulomb force acting between said electric charge and the electric charge of the latent image.

Otherwise, when a two-component developer consisting of magnetic conductive carriers C and insulating toner T is used in the same apparatus, the triboelectric brush of the conductive carriers serves, as neighboring electrodes. Accordingly, sufficient electrical field for development can be obtained even if the voltage applied between the photosensitive body 1 and the developer sleeve 22 is small. Thus, development with insulating toner can be carried out by applying low voltage.

Since it is difficult to transfer a toner image in the electric field obtained when conductive toner is employed, development with a two-component developer including insulating toner is generally preferred.

However, in the image forming process in of prior art described above, some problems arise because a plurality of processes are carried out in the developing nip N between the photosensitive body and the developer sleeve.

First, in the contact electrification process with the conductive magnetic brush, electric charge is supplied to the surface of the photosensitive body, as described above. So, the material used for the photosensitive body 1 should have a level on the surface in which electric charge can be trapped. In this case, it is difficult to use a conventional organic photo-semiconductor (OPC) although such semiconductor has no toxicity and can have functions separately.

FIG. 3A shows a case in which the OPC photosensitive body 1 was electrified with conductive particles having a volume resistivity of $10^4$ Ω . cm. In this case, when voltage of −60 V was used for electrification, the photosensitive body 1 could be charged only with voltage of −40 V. Before the electric charge converged to −40 V, the photosensitive body 1 in the apparatus shown in FIG. 2 had to make five rotations. The cleaning operation is also influenced. In this process, as described above, a cleaning operation is performed in the cleaning-electrification region Nc upstream in the developing nip N between the photosensitive body 1 and the developer sleeve 22. Actually, the cleaning operation and electrification are performed at the same time.

The Van der Waals force between the toner and the photosensitive body 1 and the Coulomb force both act on the residual toner to be removed which was not transferred. But, Coulomb force more strongly acts on the toner developed in the exposed portions than the toner in the non-exposed portions. Accordingly, when the surface of the photosensitive body 1 is electrified with the conductive magnetic brush, a cleaning operation can be performed more effectively. However, if the photosensitive body 1 does not have a good electrification characteristic, it can not be sufficiently charged in the cleaning-electrification region Nc, which causes cleaning failure and a positive ghost image. The positive ghost image may be generated not only by cleaning operation failure in which the residual toner used for the previous image forming process is not sufficiently removed, but also may be generated by an electrification failure caused by such residual toner.

On the other hand, when the a-Si photosensitive drum 1 coated with a silicon-calcium carbide layer was electrified in the same way, it could be charged with 55 V, as shown in FIG. 3B after making only two rotations of electrification. At the same time, in this reverse development system, the surface of the photosensitive drum 1 and toner are homopolar. So, repulsion forces between them remarkably improved the cleaning effect.

In short, the above-mentioned first problem is that the material used for the photosensitive body 1 can not be selected freely but must be selected from a comparatively few materials that realize a good electrification characteristic.

Secondly, even if the a-Si photosensitive body 1 is employed, a conductive magnetic brush whose resistance value is $10^3$Ω or more can not supply sufficient electric charge, which causes electrification failure. So, it is preferable to use materials for the photosensitive body 1 which have even better electrification characteristics.

Thirdly, since the a-Si photosensitive body 1 is prepared by deposition and other processes, the transparent substrate used for the photosensitive body 1 should be made of an expensive heat resistance material. Accordingly, it is desirable that the photosensitive body 1 should be made of a less expensive material, such as OPC.

SUMMARY OF THE INVENTION

An object of the present invention is to provide a photosensitive body which may be used in an image forming apparatus for simultaneously performing image exposure and development and which can be made of a wide variety of materials.

Another object of the present invention is to reliably provide an image of good quality using the above-mentioned apparatus.

In order to achieve the above objects, the electrophotographic apparatus according to the present invention which performs image exposure and development at the same time comprises an electrophotographic photosensitive body comprising a conductive layer and an electrophotographic photosensitive layer formed on a translucent substrate; optical means for exposing the image from the side of the translucent substrate of the photosensitive body; and developer means arranged opposite the side of photosensitive layer of the exposure position of the photosensitive body for supplying developer charged with a developing bias, wherein an electric charge supply layer is formed on the photosensitive layer of the photosensitive body.

DESCRIPTION OF THE PREFERRED EMBODIMENTS

Embodiments according to the present invention will be described below with reference to the drawings.

First Embodiment

Figure 2:
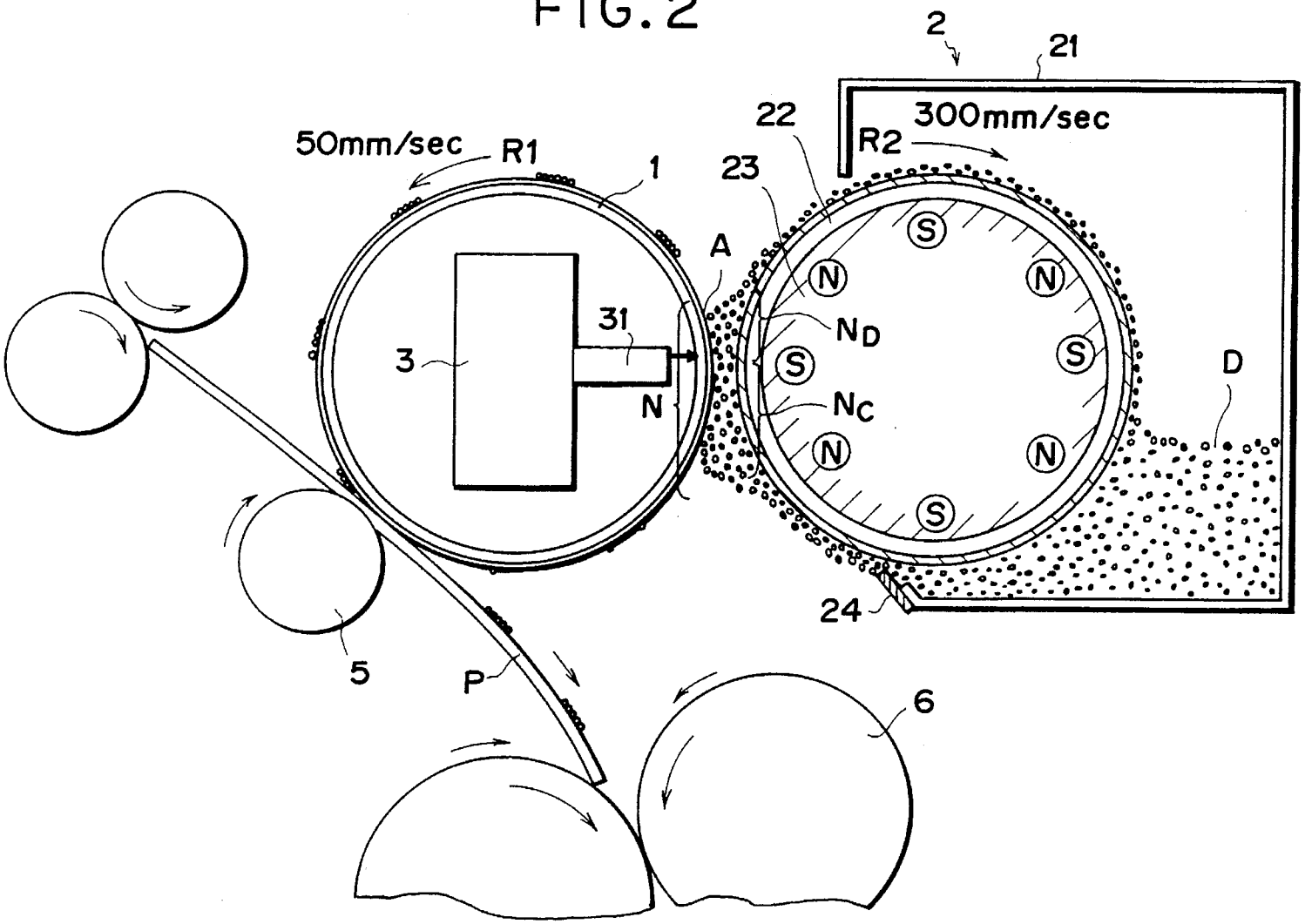
FIG. 2 is a schematic cross-sectional view showing an image forming apparatus which carries out a simplified image forming process.
Figure 3A:
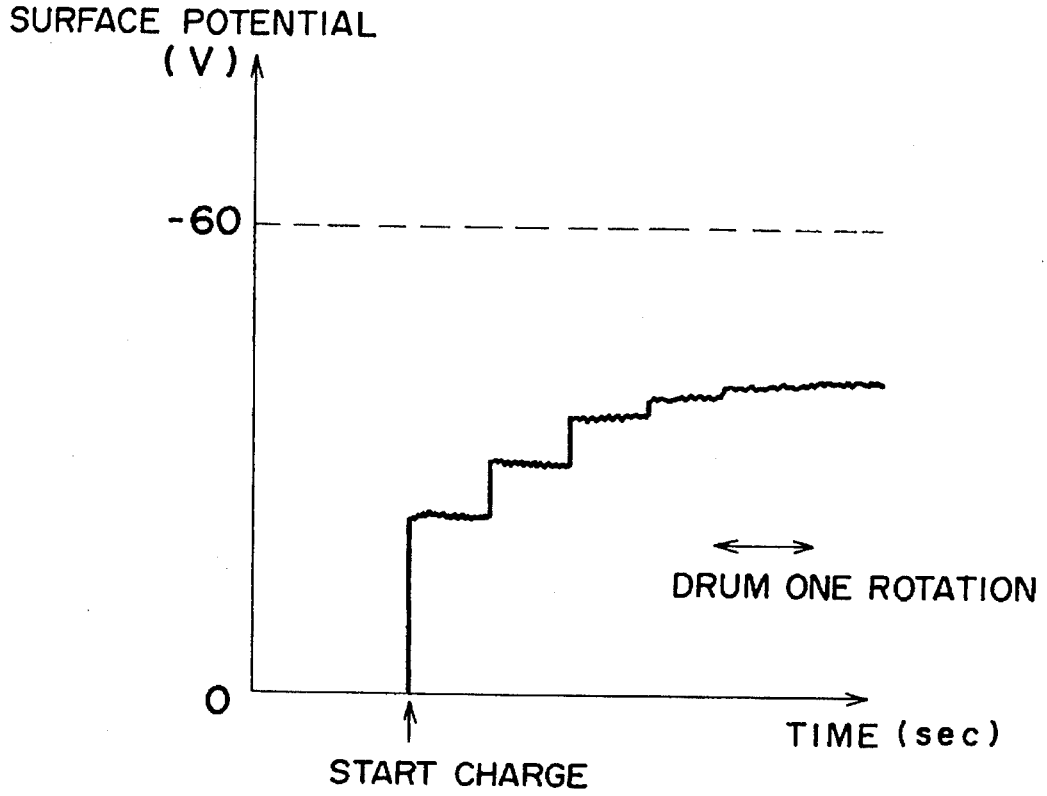
FIG. 3A is a graph showing an electrification characteristic of a conventional photosensitive body.
Figure 3B:
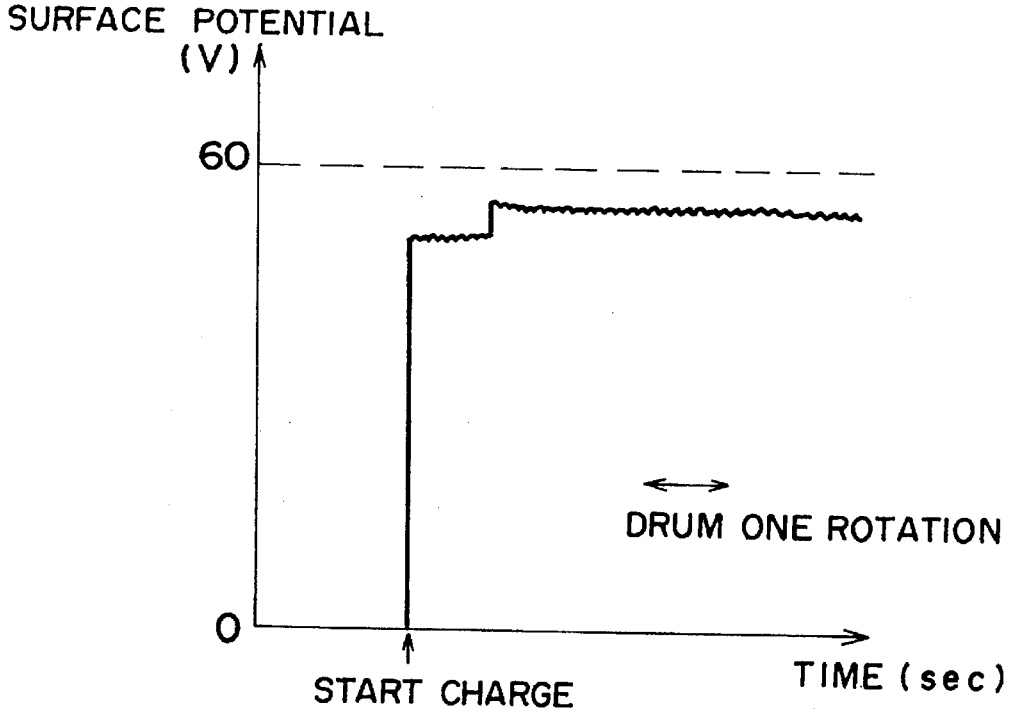
FIG. 3B is a graph showing an electrification characteristic of the photosensitive body of the first embodiment.

In the first embodiment, exposure of the back surface of the photosensitive body, cleaning operation, electrification and development are performed simultaneously ("simplified process") in the apparatus shown in FIG. 2, wherein a negatively chargeable OPC (organic photo conductor) employed here as the photosensitive body further has an electric charge supply layer formed on its surface layer.

Figure 1:
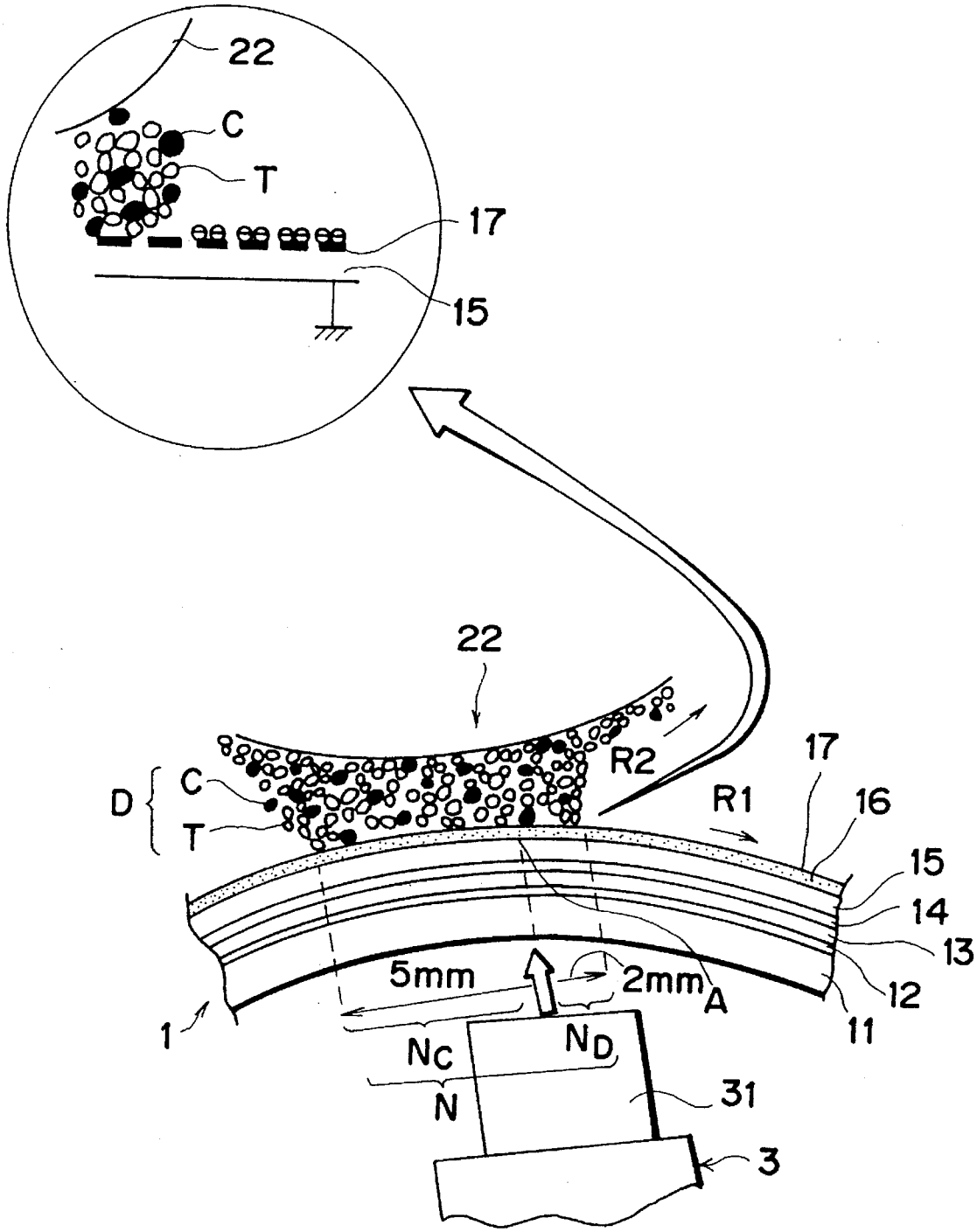
FIG. 1 is a cross-sectional view showing the structure of the photosensitive body and the developing nip of a first embodiment according to the present invention.

Now, the image forming apparatus used in the first embodiment shown in FIGS. 1 and 2 will be briefly described.

A photosensitive body 1 is a transparent glass cylinder 11 of a diameter of 30 mm on which photosensitive layers are laminated. As the material used for the cylinder 11, not only glass but also transparent resin having good dimensional stability can be employed. Further, polycarbonate, PMMA resin, or the like also can be employed.

First, the cylinder 11 is coated with about 1 μm of conductive base 12 (ITO layer) serving as a transparent conductive layer. On this ITO layer, an ordinary OPC photosensitive layer of functionally separated type is formed, which is prepared by laminating: an unchargeable layer 13 for inhibiting positive electric charge of the conductive base 12 from flowing in (UCL: thickness of 20 μm, volume resistivity of $10^6$Ω . cm); an electric charge generating layer 14 (CGL: thickness of 1 μm, polyvinyl butyral resin binder and diazo pigment); and a p-type electric charge transmitting layer (CTL: thickness of 2 μm, polycarbonate resin binder and hydrazone) 15. On this photosensitive layer, a further electric charge supply layer 16 according to the present invention is laminated.

The electric charge supply layer 16 used in this embodiment was prepared by uniformly dispersing 70 wt % of $SnO_2$ serving as conductive particles 17 (conductive fillers) in phosphazene resin serving as the binder. The thickness of the layer was 10 μm. Antimony was doped in $SnO_2$ employed here to make the particles conductive. Otherwise, indium may be doped in this ITO layer.

By dispersing the conductive particles 17 on the surface of the photosensitive body 1, the photosensitive body 1 can be utilized as a group of micro condensers. More specifically, the conductive base 12 and the conductive particles 17 serves as plate electrodes, while the electric charge transmitting layer 15 functions as a dielectric substance. The plate electrodes are charged with electricity when the surface of the photosensitive body 1 is brushed by the conductive brush.

As for the condition of dispersion of $SnO_2$ in the electric charge supply layer 16, excessive $SnO_2$ may disturb the latent image electric charge after exposure because the surface resistance of the electric charge supply layer 16 becomes too small, which occurs especially in high temperature 1 high humidity environment. On the other hand, if too little $SnO_2$ is dispersed, $SnO_2$ particles are not exposed outward on the surface of the electric charge supply layer 16. Thus, sufficient electric charge is not supplied and partial electrification failure occurs. In this case, a solid white image (non-exposed portions) obtained in a reverse development system suffers from defects such as sandy black spots, overall fogging, and so on. In order to prevent such defects, the amount of dispersed $SnO_2$ in the electric charge supply layer 16 is preferably within a range of 2 to 100 wt %.

Next, the developer device 2 shown in FIG. 2 will be described.

The developer device 2 comprises a developer container 21 for containing developer D, a rotary developer sleeve 22 of a diameter of 30 mm and a fixed magnet 23 arranged inside the developer sleeve 22, while the photosensitive body 1 is rotated in the direction of arrow R1 (counter clockwise) in FIG. 2, the developer sleeve 22 is rotated in the direction of the arrow R2 (clockwise in FIG. 2) at a circumferential speed six times as high as that of the photosensitive body 1. Therefore, in the developing nip N between the photosensitive body 1 and the developer sleeve 22, the surface of the photosensitive body 1 and that of the developer sleeve 22 move in the same direction, while the surface of the developer sleeve 22 moves six times as fast as that of the photosensitive body 1. In this embodiment, the circumferential speed of the photosensitive body 1, which determines the speed of the image forming process, is set to be 50 mm/sec. Therefore, the circumferential speed of the developer sleeve 22 is 300 mm/sec.

The cylindrically formed fixed magnet 23 has eight poles at regular intervals around its axis, as shown in FIG. 2. The peak position of each magnet is arranged to be on a line drawn from the center of the photosensitive drum 1 to the center of the developer sleeve 22. The value of magnetic induction at the peak position on the surface of the developer sleeve 22 is designed to be 800 gauss.

As shown in FIG. 1, the developer D is a mixture of the following components; magnetic conductive carriers C (hereinafter also referred to as simply "carriers") and magnetic insulating toner T (also referred to as simply "toner").

The magnetic conductive carriers C contribute to cleaning of the residual toner on the photosensitive body 1 which was not transferred, electrification of the surface of the photosensitive body 1 and transmission of the toner. The grain diameter of the carriers C is 25 μm and the value of volume resistivity is $10^3\Omega$ . cm. The carriers are resin carriers prepared by dispersing magnetite, and for the sake of increasing conductivity, carbon black in polyester. The toner T is a negative toner, whose grain diameter is 7 μm and whose volume resistivity is $10^{14}\Omega$ . cm. The toner T and the carriers C are mixed at a T/D rate of 15% (the weight percentage of the toner T in the total weight of the developer D). The mixture is contained in the developer container 21. The resultant developer shows, as a whole, resistance of $1\times10^4\Omega$.

In the developer container 21, the developer sleeve 22 is faced with a metal blade 24 for regulating the thickness of a layer of the developer D on the developer sleeve 22 to be about 1 mm. The clearance between the developer sleeve 22 and the photosensitive body 1 is determined to be 0.5 mm by means of contact rollers (not shown) provided at the end portions of the developer sleeve 22 and the photosensitive body 1. In this way, the developing nip N formed by the developer D between the photosensitive body 1 and the developer sleeve 22 which are rotated at respective predetermined speeds is determined to be about 7 mm.

A voltage of −60 V is applied to the developer sleeve 22 and through it to the photosensitive body 1, to perform a reverse development process with a negatively changes toner.

An exposure means 3 having an LED array 31 is arranged inside the cylindrical photosensitive body 1 to illuminate the back surface of the photosensitive body 1 at the position of the developing nip N. More specifically, the back surface, exposure position A is 2 mm upstream from the downstream edge of the developing nip N. That is, the overall length of 7 mm of the developing nip N is divided by the back surface exposure position A into a 5 mm of cleaning-electrification region Nc upstream with respect to the direction of rotation of the photosensitive body 1 (indicated by the arrow R1); and a 2 mm downstream development region $N_D$. If the back surface exposure position A is arranged too upstream (with too narrow a cleaning-electrification region Nc), then the latent image formed by exposure is charged again by the conductive carriers C and the contrast of the latent image decreases. In this case, the density of the resultant image can not be sufficient. On the other hand, if the back surface exposure position A is arranged too far downstream, then development must be carried out in the too small development region $N_D$, which also causes insufficient image density.

An example of an image forming process using the above-mentioned apparatus now will be described.

Upstream in the developing nip N formed by the photosensitive body 1 and the developer sleeve 22, the residual toner on the photosensitive body 1 used in the previous image forming operation is scraped off by the magnetic brush which is rotated by the developer sleeve 22 at high speed. At the same time, the conductive carriers C come into contact with the photosensitive body 1 to supply electric charge to the conductive particles 17 in the electric charge supply layer 16 of the photosensitive body 1. Thus the photosensitive body 1 is charged with electricity. In this embodiment, when a voltage of −60 V was applied to the developer sleeve 22, the photosensitive body 1 got a potential of −55 V. As electrification and a cleaning operation are performed at the same time, a repulsion force is generated between the toner T and the charged surface of the photosensitive body 1, which further improves the cleaning effect.

The back surface of the photosensitive body 1 is illuminated at the back surface exposure position A by the LED array B1 to reduce the potential of the exposed portions to −5 V. After exposure, contact development in the electric field is carried out in the developing nip N. In this embodiment, the potential in the non-exposed portions is −55 V and the potential in the exposed portions is −5 V. In other words, 50 V of development contrast can be obtained. Since the tip of the triboelectric brush of the conductive carriers C is very close to the photosensitive body 1, the developing electric field acting on the toner T is strong enough to increase the image density. Actually, a density of about 1.3 as the reflection density was obtained, that is, an image of high density and high resolution was obtained.

The developed toner image is transferred onto the transfer medium P by the transfer roller 5 shown in FIG. 2. The transfer roller 5 employed in this embodiment had a resistance of $5\times10^8\Omega$ and the transfer voltage (applied bias) was +500V. The toner which is not transferred in the transfer position will be scraped off upstream in the developing nip N during the next image forming operation, and will not damage the image forming process. Subsequently, the transferred toner image is fixed on the transfer medium P by a fixing roller 6, and then the transfer medium P is ejected out of the apparatus.

Also the OPC photosensitive body 1 advantageously compares with the a-Si photosensitive body with respect to the manufacturing cost, manufacture condition required, and so on, and can realize an inexpensive, simply-constructed image forming apparatus.

Second Embodiment

In this embodiment, a colored (including black) electric charge supply layer 16 is formed on the photosensitive layer to prevent deterioration of the photosensitive body 1 caused by external light. More specifically, colored material (black with carbon black, or white with titanium oxide) is used as the conductive particles 17 dispersed in the electric charge supply layer 16, wherein the conductive particles 17 contribute not only an electric charge supply but also a shield from light.

In general, a photo-semiconductor has photo memory effect or is irreversibly deteriorated after a long period of exposure to light, or when illuminated with strong light. Therefore, for example, a drum shutter is provided to protect the photosensitive body 1 from external light. But the drum shutter can not protect the photosensitive body 1 when the apparatus is opened at the time of, for example, a maintenance check. Also during the image forming operation, stray light generated inside the apparatus (such as the light from the exposure device and pre-exposure device, the glow of a halogen heater, light emitted from the LEDs on the electric substrate, etc.) sometimes disturbs the image.

Such problems are all caused by the fact that the outer surface of the photosensitive body is exposed to light in the conventional image forming apparatus. In other words, they are caused because the light for image exposure and the stray light can not be distinguished. However, in the case where the back surface of the photosensitive body 1 is exposed to perform image exposure, as in the present invention, the light for image exposure always comes from the back side, while all the other light such as external light and stray light comes from outer side. Therefore, a shield means provided on the outer surface of the photosensitive body 1 can remove such harmful light.

Therefore, in this embodiment, the conductive particles 17 dispersed in the electric charge supply layer 16 as in the First Embodiment has not only an electric charge support function, but also a light shielding function to prevent the photo-semiconductor from being deteriorated by external light and stray light.

Conductive particles 17 having both the electric charge support function and the light shielding function include: black substance such as conductive carbon (carbon black, kechene black, acetylene black) and titanium oxide; white substance making the surface white to reflect external light such as titanium dioxide (treated with antimony-doped stannic oxide to control conductivity); and conductive, light-reflecting or light-absorbing metal particles, or the oxides thereof.

In this embodiment, titanium dioxide was used in the experiment. The same apparatus as in the First Embodiment was used. The only difference is that the electric charge supply layer 16 of the photosensitive body 1 which was prepared by dispersing 120 wt % of titanium dioxide in polypropylene resin binder. The amount of dispersion differs from that of the First Embodiment, because titanium dioxide has a specific volume resistivity higher than stannic oxide used in the First Embodiment. In order to prevent electrification failure and disturbed images, the amount of dispersed titanium dioxide is preferably within a range of 5 to 250 wt %. Though polypropylene resin is used as the binder in this embodiment, any material which forms a good coating and is a good insulator (overall resistance does not preferably vary when absorbing moisture) may be used. In order to improve the light-shielding function, however, preferably the resin has its own color.

The photosensitive body 1 was coated with the disperse system by dipping, and an electric charge supply layer 16 of a thickness of 5 μm was formed. The resultant photosensitive body 1 appeared white. Thus, light in the ordinary working condition can be sufficiently reflected and can not deteriorate the photosensitive layer beneath the electric charge supply layer 16.

As described above, in this embodiment, the photosensitive body 1 is coated with an electric charge supply layer 16 in which light-shielding conductive particles are dispersed. Accordingly, the image forming apparatus can be easily operated.

Incidentally, the present embodiment is effective especially when it is applied to an image forming apparatus carrying a detachable photosensitive body cartridge in which a light-shielding shutter for the photosensitive body must be provided.

Third Embodiment

In this embodiment, the electric charge generating layer (CGL) 14 and the electric charge transmitting layer (CTL) 15 of the photosensitive body 1 of the First Embodiment are laminated in reverse sequence, wherein a positively chargeable photosensitive body 1 with a p-type photo-semiconductor is prepared.

In the simplified process according to the present invention, the potential in the non-exposure portions and development voltage differs little from each other, wherein fogging generated in the non-image portions is a big problem. For example, in the First Embodiment, the potential in the non-exposure portions is −55 V, while the developer sleeve 22 is charged with −60 V. Thus, even the non-image forming portions have a potential difference of 5 V for development. Especially, when the triboelectricity of the toner is high, development of the non-image forming portion is promoted and fogging becomes remarkable. In fact, fogging becomes more troublesome in the low temperture/low humidity environment where toner is highly charged. In such an environment, a 5 V potential difference is enough to carry out development because of the high triboelectricity of the toner as well as the strong attraction between the toner and the photosensitive body 1. Therefore, to perform the simplified process properly, low triboelectricity should be always realized regardless of environmental conditions.

The toner used in the present invention is a pulverized toner, which is a mixture of resin, magnetite, electrification control agent and lubricant. As most of the typical resins used for toner such as polyester resin, styvene acrylic resin and so on, tend to be negatively chargeable, and they can be easily charged with an excessive negative electricity even if an electrification control agent suppresses the triboelectricity. Accordingly, in order to obtain stable toner with low triboelectricity, it is preferable to employ a positively chargeable toner. However, when the organic photo-semiconductor (OPC) is employed in order to obtain a high withstanding voltage characteristic, there is no n-type OPC which can be practically used with respect to stability. Thus, positively chargeable OPC can not be used for the photosensitive body.

In order to prepare a positively chargeable photosensitive body by using a p-type photo-semiconductor, an ordinary photosensitive body of functionally separated type may be prepared, wherein the CGL layer 14 and the CTL layer 15 are laminated in reverse sequence. However, as the CGL layer is easily scraped, a protection layer also generally is formed in the prior art. But, according to the present invention, as the electric charge supply layer 16 also serves as a protection layer, an additional protect layer does not have to be provided. Thus, the positively chargeable photosensitive body 1 can be easily prepared.

An experiment was conducted as follows. The same apparatus used in the First Embodiment was used. Only the photosensitive body and the toner were changed.

The photosensitive body used here was prepared in the same manner as the First Embodiment except that the CTL layer 15 and the CGL layer 14 were laminated in reverse sequence. The negative toner used in the First Embodiment was replaced by a positive toner in this embodiment. The positive toner comprises 100 volume units of styrene acrylic resin, 50 volume units magnetite, 10 volume units of polypropyrene as the lubricant and a powder of copy blue kneaded and crushed to obtain a diameter of 7 μm as the electrification control agent. Silica was added as an additive agent.

Images were formed with the photosensitive body and the toner prepared as described above, and compared with images obtained from the negatively chargeable photosensitive body and the negative toner used in the First Embodiment. The image obtained as in the First Embodiment in a normal, low temperature/low humidity environment was first stable with a triboelectricity of about −10 μC/g and showed only a negligible amount of fogging, 1% in the non-image forming portions. After making idle rotations for ten minutes in a low temperture/low humidity environment, the image obtained according to the First Embodiment showed a triboelectricity of as large as −18 μC/g, and the amount of fogging on the transfer medium reached 4%.

On the other hand, images obtained according to the present embodiment with the positively chargeable photosensitive body in combination with the positive toner were stable with a triboelectricity of about +10 μC/g and showed an amount of fogging of 1%. These values did not change even after a long period of operation.

According to the present invention described above, even a p-type organic photo-semiconductor can be used for the positively chargeable photosensitive body simply by forming the electric charge supply layer on the surface of the photosensitive body, for the electric charge supply layer also serves as a surface protection layer. It is possible to reduce the amount of troublesome fogging in the non-image forming portions, which is caused by excessively charged toner in the conventional simplified process, by using a positively chargeable photosensitive body according to the present invention in combination with the positive toner.

As described above, the present invention has the following effects.

According to the present invention, an image of good quality can be obtained with an image forming apparatus which carries out what is called "simplified process" (in which cleaning, electrification and development are all performed in the developing nip, and the back surface of the photosensitive body is illuminated for image exposure), even if a photosensitive material is used which does not have a sufficient electric charge support capacity, and thus previously has not been used in the simplified process. This effect can be obtained by providing the electric charge supply layer on the surface of the photosensitive body. In particular, an organic photo-semiconductor which is widely used because of its facility for handling and designing can also be used in the simplified process.

Further, by using a photosensitive body having a good electrification characteristic, not only can the surface of the photosensitive layer be electrified with the magnetic brush, but also a cleaning effect can be improved, which greatly contributes to a simplified back surface exposure process in which a cleaning operation and electrification are performed at the same time. In addition, by using colored particles as the conductive particles used for the electric charge supply layer, the electric charge supply layer can not only improve the electric charge support capacity of the photosensitive body but have a light-shielding effect. Thus, the photosensitive layer can be easily protected from harmful external light.

What is claimed is:

1. An electrophotographic apparatus for forming an image on an endless electrophotographic photosensitive member by exposing one side of the electrophotographic photosensitive member to a light image and supplying a developer to the other side of the photosensitive member, said electrophotographic photosensitive member including a conductive layer disposed on a translucent substrate, a photosensitive layer made of an organic photoconductive material and disposed on the conductive layer, and an electric charge pour-in layer made of an insulative binder in which conductive powder is dispersed, said apparatus comprising:

optical means for exposing an interior side of the translucent substrate of said electrophotographic photosensitive member to a light image; and developing means disposed at a position corresponding to an exposure position of said electrophotographic photosensitive member by said optical means, for forming a magnetic developer brush having a magnetic conductive carrier and an insulative toner to which a bias is applied, said brush being contactable with a surface of said electrophotographic photosensitive member, spanning an upstream side and a downstream side of the exposure position, wherein said photosensitive member is charged by supplying electric charge into the electric charge pour-in layer upstream of the exposure position of said electrophotographic photosensitive member in a moving direction thereof by the magnetic brush, and wherein the insulative binder and the conductive powder are colored.

2. An electrophotographic apparatus according to claim 1, wherein the color of the conductive power is black.

3. An electrophotographic apparatus according to claim 1, wherein the color of the conductive power is white.

4. An electrophotographic apparatus for forming an image on an electrophotographic photosensitive member by exposing one side of the electrophotographic photosensitive member to a light image and supplying a developer to the other side of the photosensitive member, said electrophotographic photosensitive member including a cylindrical conductive layer disposed on a translucent substrate, a photosensitive layer made of an organic photoconductive material and disposed on the conductive layer, and an electric charge pour-in layer made of an insulative binder in which conductive powder is dispersed, said apparatus comprising:

LED optical means for exposing an interior side of the translucent substrate of said electrophotographic photosensitive member to a light image; and developing means disposed at a position corresponding to an exposure position of said electrophotographic photosensitive member by said optical means, for forming a magnetic developer brush having a magnetic carrier and an insulative toner to which a bias is applied, said brush being contactable with a surface of said electrophotographic photosensitive member, spanning an upstream side and a downstream side of the exposure position, wherein said electrophotographic photosensitive member is charged by supplying electric charge into the electric charge pour-in layer upstream of the exposure position of said electrophotographic photosensitive member in a moving direction thereof by the magnetic brush, and wherein the insulative binder and the conductive powder are colored.

* * * * *

UNITED STATES PATENT AND TRADEMARK OFFICE

CERTIFICATE OF CORRECTION

PATENT NO. : 5,587,773 Page 1 of 2

DATED : December 24, 1996

INVENTOR(S) : HIDEYUKI YANO, ET AL.

It is certified that error appears in the above-indentified patent and that said Letters Patent is hereby corrected as shown below:

Title page, item

[56] References Cited

U.S. PATENT DOCUMENTS

"4,547,737 10/1985 Kaneko et al....346/160"
should read
--4,547,787 10/1985 Kaneko et al....346/160--.

OTHER PUBLICATIONS

", p-241," should read --, p. 241,--.

COLUMN 1

Line 19, "like)" should read --like),--.
Line 37, "copies" should read --copies,--.

COLUMN 2

Line 60, "in of" should read --of--.

UNITED STATES PATENT AND TRADEMARK OFFICE

CERTIFICATE OF CORRECTION

PATENT NO. : 5,587,773 Page 2 of 2

DATED : December 24, 1996

INVENTOR(S) : HIDEYUKI YANO, ET AL.

It is certified that error appears in the above-indentified patent and that said Letters Patent is hereby corrected as shown below:

COLUMN 6

Line 29, "changes" should read --charged--.
Line 38, "of" should be deleted.
Line 42, "too" should read --too far--.
Line 49, "the" should be deleted; and "develop-" should read --a develop--.

COLUMN 7

Line 6, "B1" should read --31--.
Line 53, "Also" should read --Also,--.

COLUMN 8

Line 14, "light" should read --light,--.
Line 22, "which" should be deleted.

Signed and Sealed this

Third Day of June, 1997

*Attest:*

*Attesting Officer*

Bruce Lehman

BRUCE LEHMAN

*Commissioner of Patents and Trademarks*